US007214871B2

(12) United States Patent
Hasenmaier

(10) Patent No.: US 7,214,871 B2
(45) Date of Patent: May 8, 2007

(54) TRANSMITTER FOR SOUND RECORDING OF AN ELECTRIC SIGNAL FROM AN ACOUSTIC DRUM

(76) Inventor: Jürgen Hasenmaier, Mozartweg 14, 89542 Herbrechtingen (DE)

( * ) Notice: Subject to any disclaimer, the term of this patent is extended or adjusted under 35 U.S.C. 154(b) by 0 days.

(21) Appl. No.: 10/858,037

(22) Filed: Jun. 1, 2004

(65) Prior Publication Data

US 2005/0016367 A1 Jan. 27, 2005

(30) Foreign Application Priority Data

Jul. 8, 2003 (DE) ..... 103 30 967

(51) Int. Cl.
*G10H 3/00* (2006.01)

(52) U.S. Cl. ..... 84/723; 84/730; 84/411 R

(58) Field of Classification Search ..... 84/723, 84/743, 730, 411 R, 453, 477 R
See application file for complete search history.

(56) References Cited

U.S. PATENT DOCUMENTS

| | | | | |
|---|---|---|---|---|
| 4,899,633 | A * | 2/1990 | Lombardi | 84/730 |
| 4,984,498 | A * | 1/1991 | Fishman | 84/730 |
| 5,036,742 | A | 8/1991 | Youakim | 84/411 R |
| 5,056,403 | A * | 10/1991 | Yamashita | 84/723 |
| 5,134,920 | A * | 8/1992 | Clark | 84/730 |
| 5,345,037 | A * | 9/1994 | Nordelius | 84/730 |
| 5,977,473 | A * | 11/1999 | Adinolfi | 84/723 |
| 2001/0045156 | A1* | 11/2001 | Mishima | 84/723 |
| 2004/0134332 | A1* | 7/2004 | Kamijima et al. | 84/411 R |

FOREIGN PATENT DOCUMENTS

| | | |
|---|---|---|
| DE | 295 06 034 | 8/1995 |
| EP | 0 542 706 | 7/1999 |
| WO | WO 90/03639 | 5/1990 |
| WO | WO 02/065445 | 8/2002 |

* cited by examiner

*Primary Examiner*—Lincoln Donovan
*Assistant Examiner*—Christina Russell
(74) *Attorney, Agent, or Firm*—Baker & Daniels LLP

(57) ABSTRACT

A transmitter for recording of an electric signal from an acoustic drum having a vibration-sensitive device for attachment to the drumhead and for acquisition of undulations which has one of the following profiles: sector shape, sector shape with a tip turned toward the center of the drumhead, sector shape with concave sides and with a tip turned toward the center of the drumhead, circular shape with wart-like projection turned toward the center, elliptical shape with wart-like projection, which is arranged at radius of curvature one side large and is directed towards the center of the drumhead, or rectangular shape with wart-like projection which is arranged on a lateral edge of the rectangle and is directed towards the center of the drumhead.

4 Claims, 4 Drawing Sheets

TRANSMITTER FOR SOUND RECORDING OF AN ELECTRIC SIGNAL FROM AN ACOUSTIC DRUM

BACKGROUND OF THE INVENTION

The invention relates to a transmitter for reception of an electric signal from an acoustic drum. The transmitter comprises a vibration-sensitive body, which is designed in such a way that it lies on the drumhead, whose undulation it can acquire and record.

It is well known to arrange transmitters or microphones on the body of an instrument in order to receive an electric signal which can be used for the activation of synthesizers or for the conversion of MIDI information (Musical Instrument Digital Interface).

Known transmitters for acoustic drums comprise as a rule a piezoelectric ceramic body, which is attached to the drumhead with a double-sided adhesive tape. The ceramic body exhibits a relatively slight thickness and in general a circular base area. The transmitters usually used acquire waves of the drumhead regardless of their direction. This triggers problems, among other things because rolls on the drumhead in the middle of the drum emit a weak signal amplitude, while rolls near the edge of the drum result in a strong signal amplitude. This is a genuine source of false signals from the transmitter and was the object of electronic corrections in the subsequent amplification circuit. Certainly it was possible in this way to eliminate a great part of the false signals; however this was dependent on the transmitter sensitivity and on the frequency range of the generated signal.

To prevent the transmitter body from being struck by the drumstick, the body is arranged in great proximity to the edge of the drum. Up until now this has also produced the shortest possible wiring to the required plug and socket device, which up to now has been provided in the form of a separated unit underneath the edge of the drum.

By means of shaping of the transmitter body area and by means of its decentralized positioning on the drumhead the transmitter reacts sensitively to all the different undulations as the result of a roll on the drumhead. Such a transmitter is also especially sensitive to decentralized rolls and the undulations generated therewith on the drumhead. A transmitter in oblong shape for a drum is well known from WO 90/03639.

A further transmitter is well known from EP 0 542 706B1. The vibration-sensitive device of that transmitter is oblong in shape. The longitudinal axis of the vibration-sensitive device points towards the middle of the drumhead.

Such a transmitter has the following drawback:

The sound level which a drumstick roll carries out on the drum depends on the location at which the drumstick strikes the drumhead. The sound level is higher, the closer the drumroll is to the edge area of the drumhead. This can be extraordinarily unpleasant and impair the playback of compositions.

SUMMARY OF THE INVENTION

The object of the invention is thus to specify a transmitter of the type initially described, which is designed in such a way that the sound level is not influenced by the location at which the drumstick strikes the drumhead.

In the process, the inventor has proceeded from the lessen teachings of EP 0 542 706B1. Instead of designing the vibration-sensitive device to be oblong, as specified in the aforementioned patent, the inventor selects a completely different shape for this device. Said device is namely of a shape that does not permit the detection of any orientation, and in any event is not "long stretched out". The vibration-sensitive device is designed in such a way that it acquires waves in a prescribed wavelength range.

The shape of a sector of a circle has proven to be particularly favorable. In the process the arc of the circle in expedient fashion has the same radius of curvature as the drumhead, so that it can be placed at the border of the drumhead and is snugly fitting. One could also say that the device has the shape of a wedge of pie. The aperture angle of the segment can amount to 90°. Deviations to the top or the bottom are possible. An angle of 70 or 80°, or even of 100 or 110° is conceivable.

Other configurations also come into consideration, for example an essentially circular configuration. In this case the device should have a projection, which points to the center of the drumhead.

BRIEF DESCRIPTION OF THE DRAWINGS

The invention is explained in detail with the aid of the drawings. The figures show the following.

DETAILED DESCRIPTION

Figure 1:
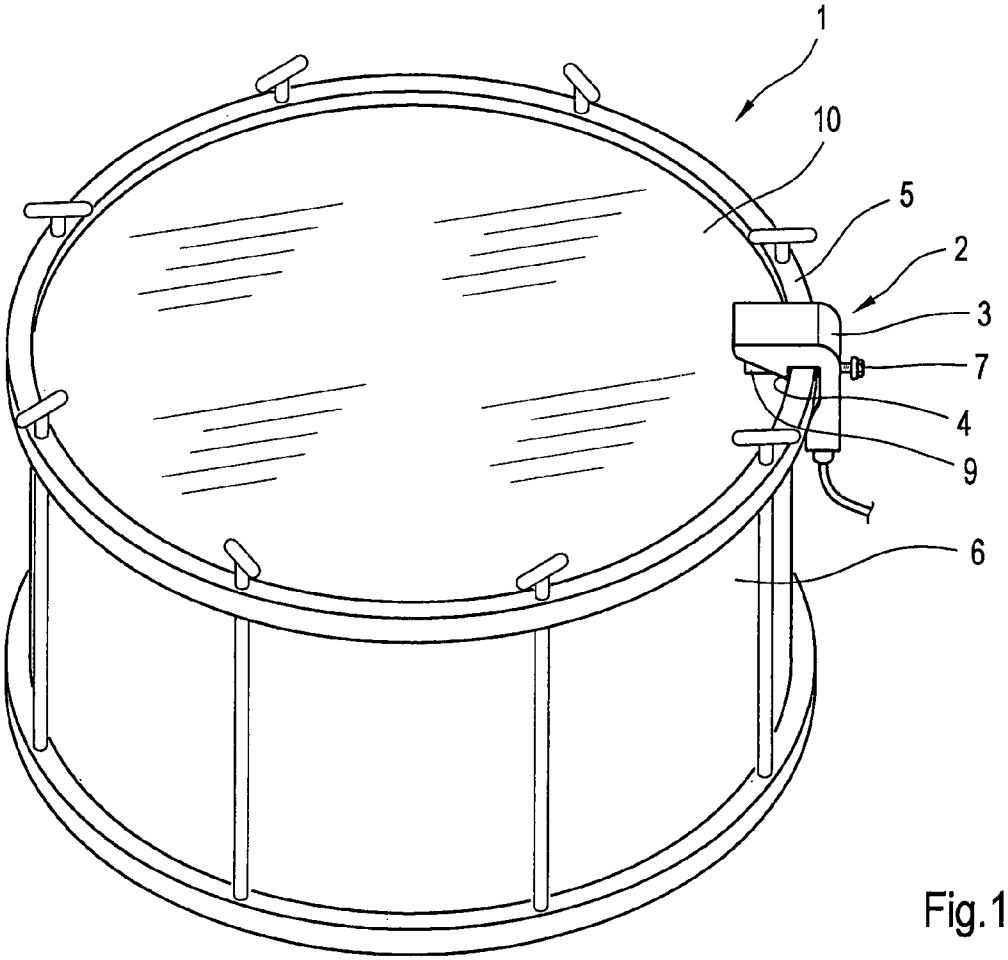
FIG. 1 is a perspective view of an acoustic drum with an attached transmitter as per the present invention.

FIG. 1 represents an acoustic drum 1 with a transmitter 2 attached to it. The transmitter 2 comprises a holder 3 with a hook 4, which takes hold of the edge 5 of the border 6 of the drum 1. The holder 3 is attached with a screw 7, which is fastened to the border 6. The transmitter 2 comprises a vibration-sensitive body 8 (FIGS. 2 and 3), which is borne by a spring device 9, which presses the body 8 against the head 10 of the drum 1.

Figure 2:
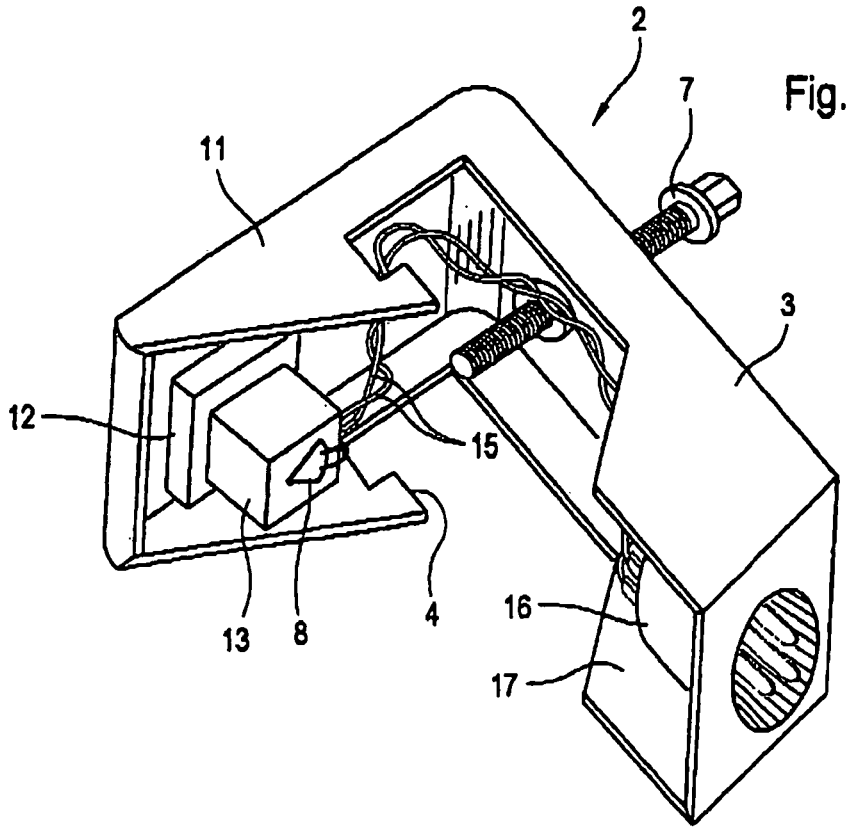
FIG. 2 is a perspective view of a transmitter as per FIG. 1, showed in non-attached state.
Figure 3:
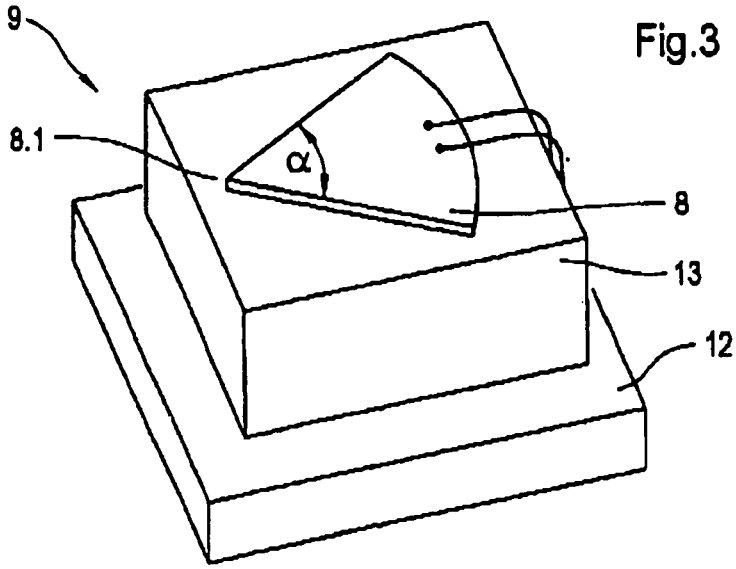
FIG. 3 is an embodiment of the vibration-sensitive body of the transmitter.

FIG. 2 represents the embodiment of the body 8 of the invention, as it is currently preferred. The holder 3 exhibits a reversed L-shape, which creates a housing-like cover 11, which protrudes from above and chiefly in a plane running parallel to the drum head 10 (FIG. 1). At the surface of the cover 11, which is directed toward the drum head 10, the vibration-sensitive body 8 is borne by the spring device 9 as shown in FIG. 3. In the preferred embodiment the device 9 consists of a piece 12, preferably made of hard rubber, which is adhered to the inner surface of the cover 11, which for its part carries a cushion 13, which is preferably made of artificial foam, to which the surface of the downward pointing vibration-sensitive body 8 is attached. The attachment takes place preferably by means of adhesion.

The vibration-sensitive body 8 is connected to the electrical conductors 15 at its base, said conductors leading to the inside of the holder 3 down to a plug and socket device 16 at the end of the foot 17 of the holder 3.

The cover 11 and the foot 17 of the holder 3 form the hook 4, whose shape is adapted to the shape of the edge 5 of the border 6 of the drum 1. By means of this hook 4 and the screw 7 the holder 3 is firmly attached to the drum 1, causing the vibration-sensitive body 8 to fit securely to the drum head 10.

One can also recognize the shape of the vibration-sensitive body 8 from FIGS. 2 and 3. The body is a sector of a circle in the plan view. It exhibits a tip 8.1. The angle α to the tip amounts in the present case to somewhat less than 90°. The following are possible: 60, 70, 80, 90, 100, 110, 120, 130, 140° with intermediate values.

The chord of the sector is in the preferred case somewhat the same length as each of the two lateral edges of the segment. The tip 8.1 of the sector can also be rounded off or even cut.

The vibration-sensitive body 8 is made of a piezoelectric ceramic material, piezoelectric synthetic material or the like.

Figure 4A:
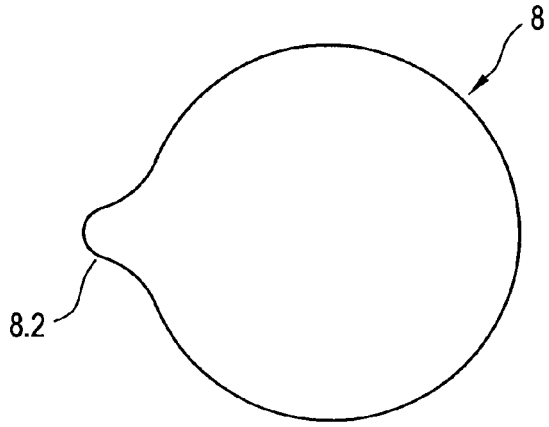
FIGS. 4*a*, 4*b*, 4*c*, 4*d*, 4*e* show variants of vibration-sensitive bodies in a plan view.

FIG. 4*a* shows one possible embodiment of a vibration-sensitive body 8 of the invention.

The body 8 as per FIG. 4*a* is at least approximately circular. It exhibits a wart-like projection 8.2. The projection could also be designed as a tip.

Figure 4B:
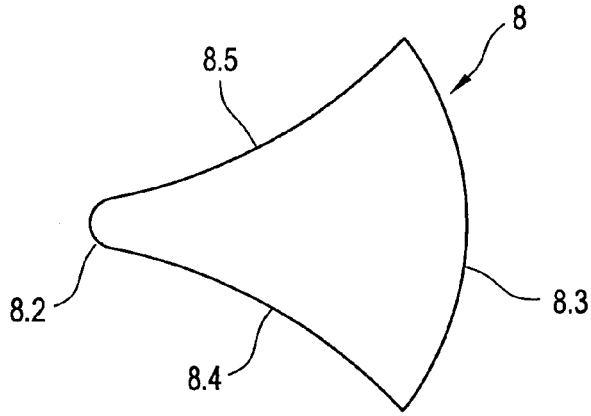

In the case of the embodiment as per FIG. 4*b* the body 8 is designed in the shape of a hatchet. The peripheral edge 8.3 of the body 8 is circular. It has the same radius of curvature as the drumhead itself. However, deviations from this are also possible. The lateral edges 8.4 and 8.5 are concave in design. Between the two lateral edges 8.4 and 8.5 a wart-like projection 8.2 is formed. Here again, a tip could be here instead of the wart-like projection 8.2.

Figure 4C:
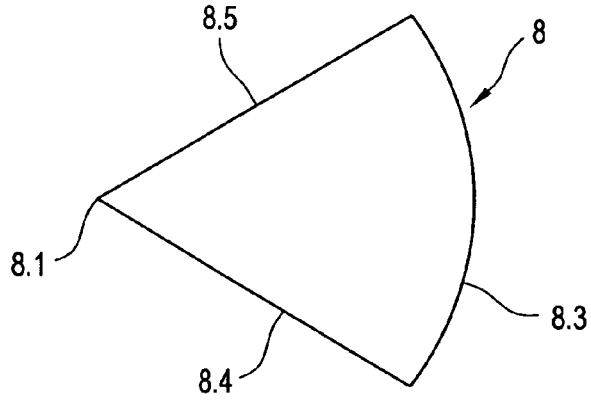

The embodiment as per FIG. 4*c* corresponds to the embodiment as per FIGS. 2 and 3. One recognizes a tip 8.1 as well as the two lateral edges 8.4, 8.5 and the peripheral edge 8.3.

Figure 4D:
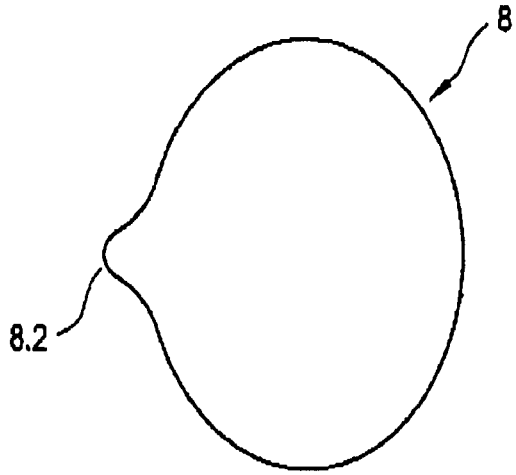

In the case of the embodiment as per FIG. 4*d* the vibration-sensitive body 8 has at least approximately the shape of an ellipse. Said ellipse in turn exhibits a wart-like projection 8.2, which is directed toward the center of the drumhead, which is not shown here. The opposing side of the ellipse has a radius of curvature, which approximates the radius of curvature of the drumhead.

Figure 4E:
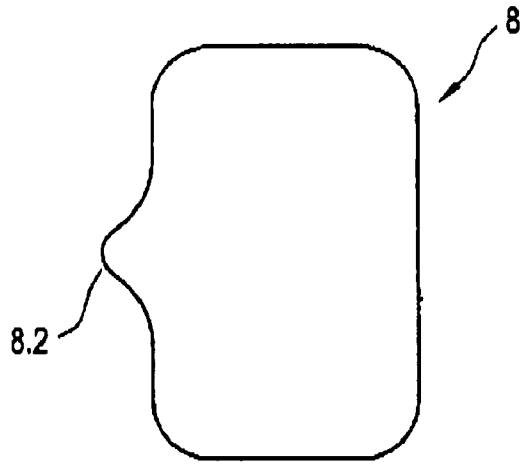

In the case of the embodiment as per FIG. 4*e* the vibration-sensitive body 8 has the shape of a rectangle with rounded off corners. Here again the wart-like projection 8.2 is present.

In all of the cases the wart-like projection could also exhibit a tip, which in mounted state points toward the center of the drumhead.

The basic idea in the case of all of the embodiments shown here 4*a* through 4*e* consists in the fact that the vibration-sensitive body 8 in mounted state viewed in radial direction of the drumhead exhibits a smaller or equally large or at the most essentially larger extension than the dimension running vertically or in the peripheral direction of the drumhead.

The invention claimed is:

1. A transmitter for recording of an electric signal from an acoustic drum including a circular drumhead having a radius of curvature, comprising:

a vibration-sensitive device adapted for attachment to the drumhead of the acoustic drum and for acquisition of undulations of the drumhead;

said vibration-sensitive device having the shape of a sector of a circle having an arcuate base with an angle α at its tip from 60° to 140°, the sector being parallel to the drumhead, the tip being opposite the base and oriented toward the center of the drumhead;

the arcuate base defining an arc that is coplanar with the base and parallel to the drumhead, the base having a radius of curvature that is substantially the same as the radius of curvature of the drumhead.

2. The transmitter of claim 1 wherein the vibration-sensitive device is a sensor that is flexibly and elastically attached in direct contact with the drumhead.

3. The transmitter of claim 1 wherein the vibration-sensitive device is designed in such a way that it acquires waves in a pre-specified wavelength range.

4. The transmitter of claim 1 wherein the vibration-sensitive device has concave lateral edges extending from the tip to the base.

* * * * *